United States Patent [19]

Buerosse

[11] Patent Number: 4,759,105

[45] Date of Patent: Jul. 26, 1988

[54] BODY CASE WITH VIEWING WINDOW

[76] Inventor: William B. Buerosse, 4950 NE. 27th Ter., Lighthouse Point, Fla. 33064

[21] Appl. No.: 899,521

[22] Filed: Aug. 22, 1986

[51] Int. Cl.[4] ..... A61G 17/00

[52] U.S. Cl. ..... 27/1; 27/6; 27/7; 27/28

[58] Field of Search ..... 27/6, 11, 17, 19, 14, 27/1, 2, 7, DIG. 1, 28; 47/79, 69; 220/74; 110/194

[56] References Cited

U.S. PATENT DOCUMENTS

| | | | |
|---|---|---|---|
| 285,034 | 9/1883 | Heysinger | 110/194 |
| 872,740 | 12/1907 | McKenzie | 27/6 |
| 962,590 | 6/1910 | Schlafly | 27/6 |
| 1,219,751 | 3/1917 | Loyd | 27/17 |
| 1,298,688 | 4/1919 | Freeman | 27/6 |
| 1,421,018 | 6/1922 | Mesker | 27/17 X |
| 1,483,544 | 2/1924 | Donnelly | 27/6 |
| 1,497,375 | 6/1924 | Knox | 27/6 |
| 1,510,557 | 10/1924 | Paden | 27/2 |
| 1,594,669 | 8/1926 | Greive | 27/17 |
| 1,963,681 | 6/1934 | Scott | 27/11 X |
| 2,141,734 | 12/1938 | Besch | 27/10 |
| 2,250,824 | 7/1941 | Davis | 27/11 X |
| 2,365,983 | 12/1944 | Vanderwerf | 10/194 |
| 2,431,183 | 11/1947 | Mansfield | 27/3 |
| 2,611,946 | 9/1952 | Etten et al. | 27/6 |
| 2,775,021 | 12/1956 | Bourgraf | 27/6 |
| 2,836,876 | 6/1958 | Ziegler | 27/6 |
| 2,945,717 | 7/1960 | Trice | 27/DIG. 1 X |
| 3,035,862 | 5/1962 | Phelps | 27/DIG. 1 X |
| 3,038,232 | 6/1962 | Wean | 27/17 |
| 3,218,688 | 11/1965 | Slaughter | 27/19 |
| 3,283,386 | 11/1966 | Cenegy | 27/7 X |
| 3,488,818 | 1/1970 | Orr | 27/2 |
| 3,534,451 | 10/1970 | Esterdahl | 27/16 |
| 3,701,455 | 10/1972 | Warnecke | 220/74 X |
| 3,781,164 | 12/1973 | McCaffery | 220/74 X |
| 3,838,482 | 10/1974 | Wallace | 27/11 |
| 3,879,818 | 4/1975 | Rowland | 27/7 |
| 4,407,053 | 10/1983 | Ball . | |

FOREIGN PATENT DOCUMENTS

| | | | |
|---|---|---|---|
| 56-516 | 5/1981 | Japan | 110/194 |
| 16194 | of 1887 | United Kingdom | 27/2 |
| 2064485 | 6/1981 | United Kingdom | 27/7 |

*Primary Examiner*—James R. Feyrer

*Attorney, Agent, or Firm*—Harry W. Barron

[57] ABSTRACT

Described herein is a body case fabricated of galvanized sheet metal and designed to contain the remains of a deceased person in an air tight environment. The case is used for shipping the remains from one area of the country to another. The body case includes a main portion which is bent to form two sides and a bottom. The case also includes a front and back panel which are joined to the main portion by preformed receiving mean joints therein and a sealant material is placed in conjunction with the forms joined to maintain an air tight seal within the body case container. Flanges are formed along the open top of the container and a gasket is placed along the formed flanges. A cover is compressibly latched over the top of the container and against the gasket to maintain an air tight seal therein. In an alternate embodiment, a window is placed in the cover and sealed in an air tight manner using a gasket and compression offset bracket against the transparent window. The window may be made of a plastic material so that the body case can be moved directly from a coffin after a final viewing ceremony and placed into a crematorium for disposal of a deceased body while maintaining isolation of the body from the surrounding environment or left in the container for burial.

4 Claims, 3 Drawing Sheets

BODY CASE WITH VIEWING WINDOW

This invention relates to a body case and more particularly to an improved air tight body case having a viewing window therein so that a body needed to be isolated from the surrounding environment may be placed in the case for viewing during a funeral and subsequently cremated.

Whenever a person dies, tradition and desires of the deceased and family generally call for a funeral to occur in the hometown of the deceased. However, in many instances, a person passes away at a place other than his hometown and the body must be shipped back to the hometown. In certain circumstances, embalming fluids placed in the body can slow down, but not totally stop, the natural process of decay. However, certain religious beliefs, or other desires, may dictate that no embalming fluid or other preservatives be added to the body and the body begins to decay very quickly. This decay causes unpleasant and unhealthful odors to emanate from the body and these odors should be isolated from surrounding areas. This is particularly true where the body is shipped by conventional transportation means which also carry passengers, such as an airplane.

The prior art contains many types of cases useful for transporting the body of a deceased person from one location to another. For example, a typical body case, known as the Zeigler case, seals the body in an air tight container. The container, which initially must be opened to allow the body to be inserted, has a lid which is secured over the top by many bolts, each of which must be secured through the cover into the main portion of the container. Typically, the sealed container is made of wood or other materials which can be glued together in order to form the air tight seals. This type of case is both heavy and expensive and the securing of the cover over the main portion is both a time consuming and inexact method of forming the air tight container due to potential leaks.

The prior art teaches caskets which have purported to be air tight, such as seen in U.S. Pat. Nos. 620,542 and 1,433,443. However, these are complex and expensive units and are not suitable for being used as a shipping container which must be able to be sealed and thereafter opened in order to place the body in a casket for a funeral. Further, such air tight caskets can not be used by members of certain religions.

In some instances, it is desirable and necessary that the body of a person who died of certain diseases be kept isolated from other people in order to prevent the transmission of the disease. For example, a person who dies as a result of meningitis may still be a carrier of that disease, even though deceased. Further, many diseases present unknown risks as to whether or not they are contagious after a person has died. For example, acquired immune deficiency has no presently known cure and the manner in which the disease is transmitted is not precisely known. Hence, when a person dies of acquired immune deficiency, people fear being placed in contact with or even close to the body. The unknown effects of the meningitis, acquired immune deficiency or other contagious diseases may limit the type of funeral that a person may have. For example, the traditional funeral includes a final viewing; however, such a viewing may not generally be appropriate due to the unknown risks involved. Further, the diseased body should be cremated rather than buried to destroy the potentially contagious virus.

If the deceased body were to be placed in an air tight container in which a viewing window were present, a traditional type funeral, including a viewing, could be had for such person. The air tight container, which prevents any contamination of people in the immediate area, could be placed in a conventional casket and a viewing through the window could occur as in a conventional funeral. Prior art coffins which include a window, such as shown in U.S. Pat. Nos. 1,421,018, 2,141,734 and 4,407,053 are not appropriate because they are not air tight. Rather, such windows are for protecting the body or valuables on the decedent. If the viewing window were of the material which would quickly melt, such as plastic, then after the funeral service the entire container could be removed from the casket and placed in the crematorium. With this procedure, a minimal contact between the contagious body and the rest of the world occurs. After the cremation, the ashes remain in the metal container and can be collected and disposed as the desires of the family or the law dictates.

In accordance with one aspect of this invention, there is provided a body case for containing a dead body which is to be maintained isolated from the surrounding area and which is to be cremated. The case is sized to be inserted within a coffin for viewing and subsequently removed from the coffin for cremation while the isolation is maintained. The case comprises a sheet metal container formed of bent corners and sealed joints and includes cover receiving means. Further, the case includes a cover for being attached to the cover receiving means to form an air tight seal and the cover includes a transparent member sealed therein. The transparent member is of a material which is destroyed when the case is placed in an operating crematorium.

One preferred embodiment of the subject invention is hereafter described with specific reference being made to the following Figures, in which.

Figure 1:
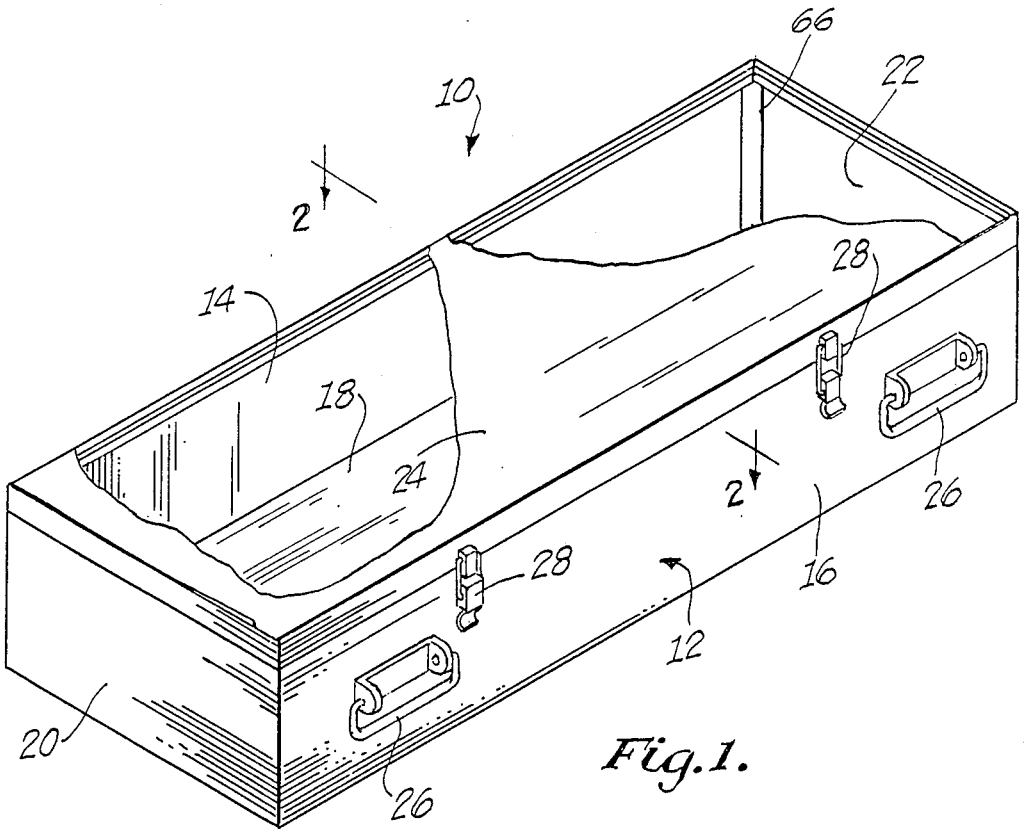
FIG. 1 shows the body case of the subject invention with the lid partially cut away.

Referring now to FIG. 1, a body case 10 is shown which is adapted to having the body of a deceased person placed therein for shipping from one location to another. To be used for this purpose, body case 10 must be an air tight container, so that bacteria and odors from the decaying body do not escape the confines of case 10.

Figure 3:
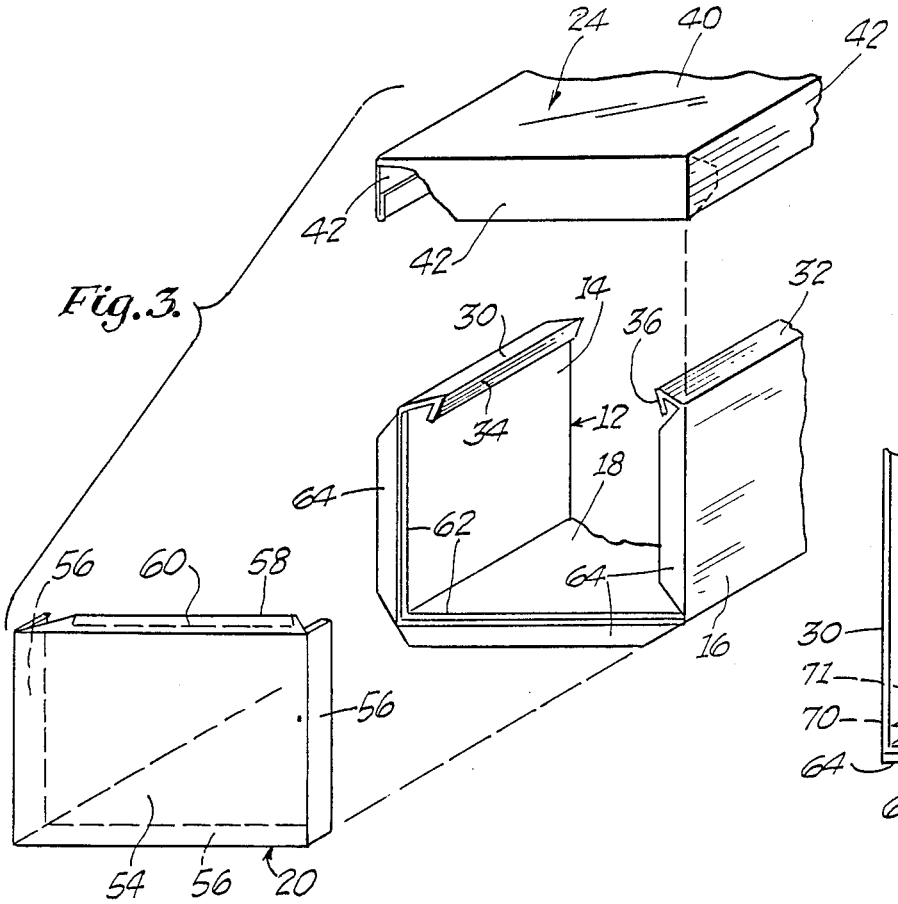
FIG. 3 shows the manner in which the various parts of the body case shown in FIG. 1 fit together.

Case 10 is formed entirely of galvinized sheet metal, which sheet metal has been bent or connected in the manner to be described hereafter to form case 10. There are four principal pieces of sheet metal bent and assembled together to form case 10. These include a main portion 12 bent to form the left side 14, right side 16 and bottom 18 of case 10. In addition case 10 includes a front panel 20 and back panel 22 which are connected to main portion 12 by joints described hereafter in FIGS. 3, 5 and 6. Finally, case 10 includes a cover 24, shown partially in cut-away in FIG. 1, which fits over the top of case 10.

Attached to the two sides 16 and 18 of case 10 are folding handles 26 and compression locks 28. Generally speaking there will be two handles 26 on each of the sides 14 and 16. Handles 26 are of a type which fold to a horizontal position when in use and otherwise are positioned parallel and adjacent to the sides 16 and 18, as seen in FIG. 1, when not in use. Each of the handles 26 may be coupled to body case 10 by conventional riveting techniques. Such riveting techniques should be of the type which do not create any appreciable air leaks between the interior and exterior of body case 10.

Figure 2:
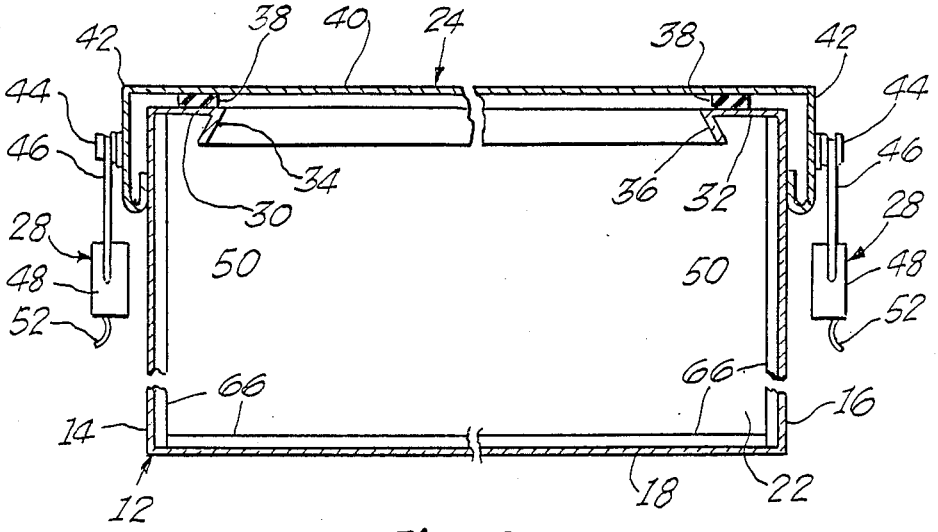
FIG. 2 shows a cross section of the body case taken across lines 2—2 of FIG. 1.

The compression locks 28 are used to hold cover 24 tightly against the container formed by main portion 12 and front panel 20 and back panel 22 assembled therewith. For a normal sized body case used for shipping a body, two compression locks 28 on each side 14 and 16 have been found sufficient. These locks are a type in which a main body is affixed by air tight rivets to the respective sides 14 and 16. The main body of locks 28 each include a U bracket extending therefrom. A U bracket receptacle is connected by rivets to the cover 24 and when the U bracket is placed in the U bracket receptacle and the main body of the compression lock 28 is pushed downward, a conventional compression fitting of cover 24 against the container portion of body case 10 is formed. The details of compression lock 28 are seen in FIG. 2. For larger type body cases, such as could be used in exhuming bodies from prior burial, it may be necessary to utilize additional compression locks. A normal body case used for shipping a body may have a width of twenty inches, a height of twelve inches and a length of seventy-three inches and a calvary type body case may have a width of sixteen and a half inches, a height of twelve inches and a length of sixty-five inches. On the other hand, the larger exhuming type body case may have a width of thirty and one-half inches, a height of twenty three and a half inches and a length eighty-five and one half inches.

Referring now to FIG. 2, a cross-sectional view of body case 10 is shown taken across lines 2—2 in FIG. 1. The main portion 12, including sides 14 and 16 and bottom 18 is a single piece of sheet metal which has been bent in a configuration shown in FIG. 2. In addition, main portion 12 includes a pair of flanges or ledges, 30 and 32 and a pair of moisture stops supports 34 and 36 bent from and thereby forming a cover receiving means on the upper edge of respective sides 14 and 16. The left flange 30 and right flange 32 are generally parallel to bottom 18 and the left moisture stop member 34 and right moisture stop member 36 are bent 120 degrees from the plane of the respective flanges 30 and 32. Thus, there is a sixty degree angle between the flange 30 and 32 and its associated moisture stop 34 and 36. Postioned on top of each of the flanges 30 and 32 along the lateral dimension thereof is a gasket 38. Gasket 38 may be a sponge rubber type material which can be compressed to form an air tight seal.

The purpose of stops and support members 34 and 36 being bent beyond the vertical is to prevent any moisture which may become present within body case 10 from contacting the gaskets 38. In the event case 10 is tipped over during the transportation thereof from one area to another, any fluids which may be within body case 10 would be trapped by the angled moisture stop and support members 34 or 36 and contained in the area between the bottom of flanges 30 or 32 and members 34 or 36. Thus, stop and supports members 34 and 36 prevent any fluid within case 10 from contacting gasket 38. In addition, stops 34 and 36 provide a mechanical support for maintaining flanges 30 and 32 rigid.

Cover 24 is a single piece of galvanized sheet metal bent to form the cover 24 and sized to fit over the main portion 12 of body case 10. Thus, cover 24 includes a top 40 and four sides 42, only two of which are shown in FIG. 2. Each of the sides 42 are generally at a ninety degree angle with respect to the top 40 and have the bottoms thereof bent upward to prevent a sharp edge from cutting the handlers of body case 12. On the two long sides 42 of cover 24, a pair of compression lock receiving brackets 44 are riveted and are adapted to receive the extension 46 from compression lock 28. The body 48 of lock 28 is coupled at hinge 50 to the sides 14 and 16 of body case 10. When handle 52 is lifted from the position shown in FIG. 2 and rotated about hinges 50, the extension 46 can easily be removed from the brackets 44. On the other hand, with extension 46 positioned in brackets 44 and the main body 48 of lock 28 being in the position shown in FIG. 2, top 24 is compressively held against gasket 38 and flanges 30 and 32 of body case 10. By compressing gaskets 38 in this manner, the air tight seal within body case 10 is formed.

Referring now to FIGS. 3, 4, 5 and 6, the manner in which front 20 is connected to main portion 12 will now be described. It should be understood that back 22 is connected in an identical fashion. Front 20 includes a flat surface 54 having lips on the right, left and bottom sides thereof which are formed by ninety degrees bends in the sheet metal. On the top of front 20 is a flange 58 bent in the same manner as flange 30 or flange 32 shown in FIG. 2. Flange 58 also includes a moisture stop and support member 60 bent at one hundred and twenty degree angle with respect to the planar surface of flange 58.

The edges of main portion 12, including the edges of side 14, side 16 and bottom 18 adopted to forming the joint with front 20 are bent to form receiving means 62 adapted to receive the lips 56 of front 20. The receiving means 62 formed in the edge of sides 14 and 16 and bottom 18 further includes a lip 64 extending out therefrom which may be bent around the corner formed by lips 56 and surface 54.

Figure 5:
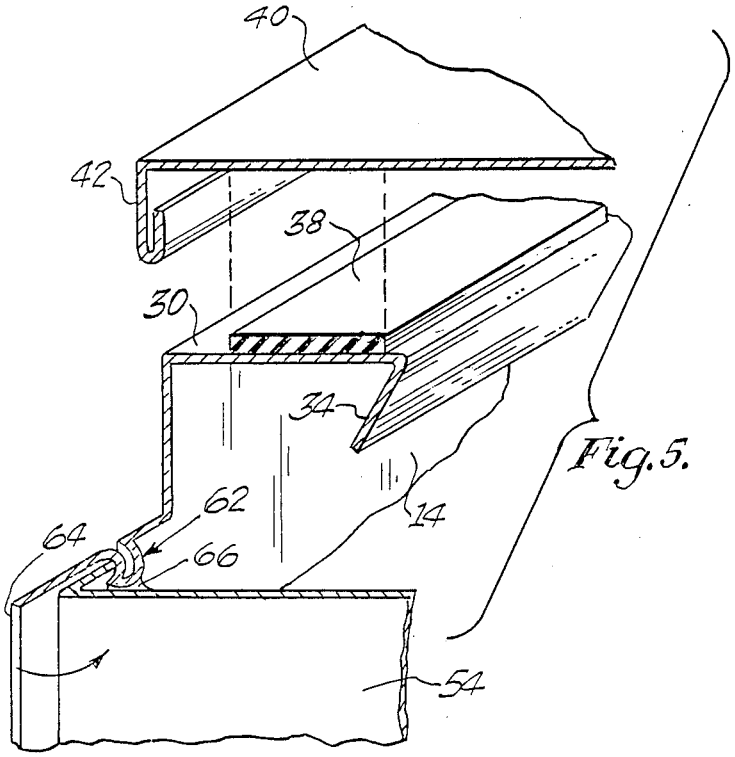
FIG. 5 shows a partial cut-away view of the manner in which the body case shown in FIG. 1 is constructed.
Figure 6:
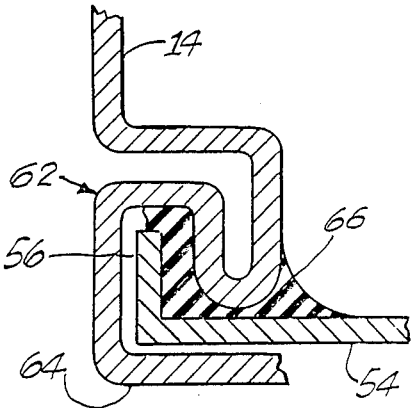
FIG. 6 shows a more detailed diagram of the joint formed by the edges and sides of the body case.

Receiving means 62 is bent as best seen in FIGS. 5 and 6. Such a configuration is described in U.S. Pat. No. 417,813, in the name of S. C. Davidson entitled "Metal Box or Chest" which patent was granted Dec. 24, 1889. Basically, the receiving means 62 includes a pair of bends inward of the case and thereafter bending the sheet metal outward to leave an opening into which lip 56 may be placed. After lip 56 is inserted into the formed opening of receiving means 62, lip 64 is bent at a ninety degree angle to maintain front 20 firmly in place.

The joint formed, as shown in FIGS. 5 and 6, has many advantages particularly relating to the strength of the joint as well as the ease of fabrication of the resulting structure. However, one of the problems with the type of joint shown in FIGS. 5 and 6, is that it is not an air tight joint as required by the use of body case 10. This should be contrasted between the corners between, for example, the sides 14 and 16 and the bottom 18 which is merely a bend in the sheet metal and as such is air tight. In order to overcome the non-air tight joint problem, a sealant material 66 is added to the corner joint formed by the placement of lip 56 into receiving means 62 and the bending of lip 64. Such a sealant may be preferably a silicone or butyle type sealer which forms an air and fluid tight seal in the joint formed by inserting lip 56 into receiving means 62. The sealant material 66, of course, is placed around the junction between the sides 14 and 16 and the bottom 18 where they join with front 20. FIG. 6 shows that sealant material 66 flows into the space between the middle of side 14 and the middle of surface 64 and lip 56. It further flows into and through the area of the corner of body case 10 to form a solid seal thereat. Thus, with sealant 66 in place and cover 24 compressibly affixed against gasket 38, the interior of body case 10 is air tight and odors or fluids therein cannot escape to the outer environment.

Figure 4:
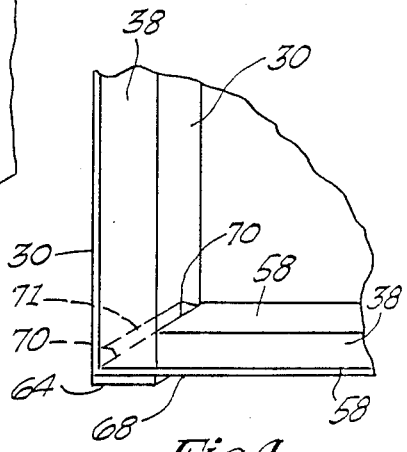
FIG. 4 shows one corner of the body case and illustrates the manner in which the gasket between the main part of the body case and the cover of the body case is positioned.

In order that gasket 38 form a good seal when cover 20 is compressibly affixed against gasket 38, gasket 38 is placed on the flanges 30 and 58 so as to be overlapping, as seen in FIG. 4. Since flange material 38 is a foam rubber type material, it can be compressed at the overlap spot area 68 and still maintain a sealed junction. By overlapping the strips of gasket 38, a better seal is formed compared to cutting the strips of gasket material 38 and butting them together. This latter technique is prone to leaving a space where the gasket strips fit together.

It should be noted that the various flanges 30 and 32, as well as 58, are formed with an overlapping forty-five degree angle therein so that they fit over one another, again as seen in FIG. 4. Gasket 38 should be positioned close to the outer surface of sides 14 and 16 and front 20 so that the sealing action provided by gasket 20 is away from the interior of body case 10 and the junction of the flanges 30 and 32 with flanges 58.. At the same time the sealant material 66 should extend under edges 70 and 71 formed by the junction of flanges 30, 32 and 58 to prevent any leaks as a result of joint 70.

Figure 7:
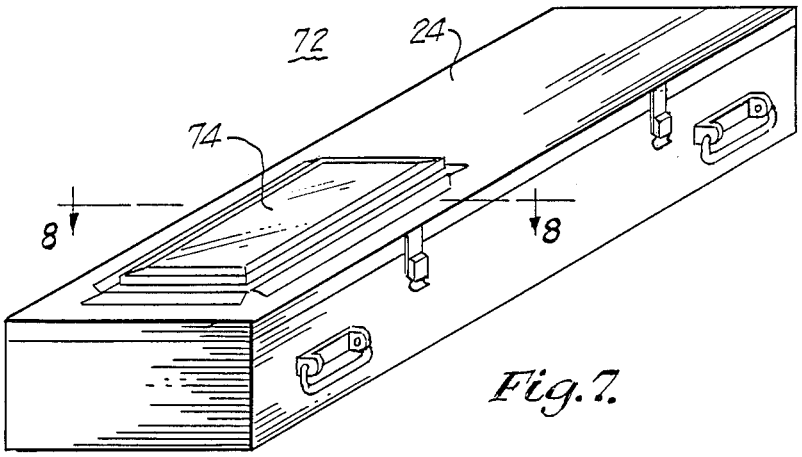
FIG. 7 shows a second embodiment of the body case of the subject invention including a viewing window therein.
Figure 8:
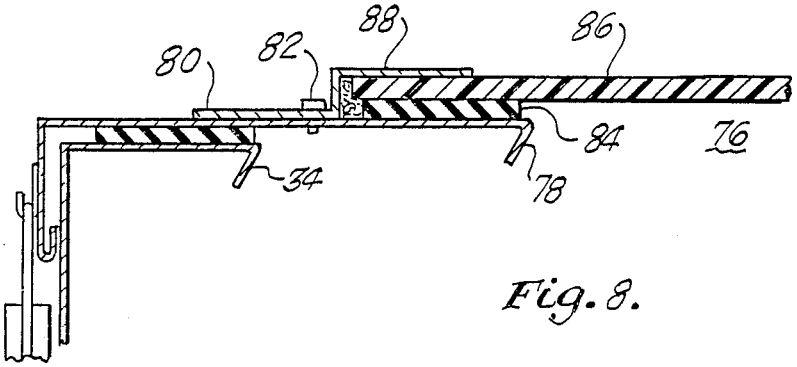
FIG. 8 shows a view taken across line 8—8 of FIG. 7.
Figure 9:
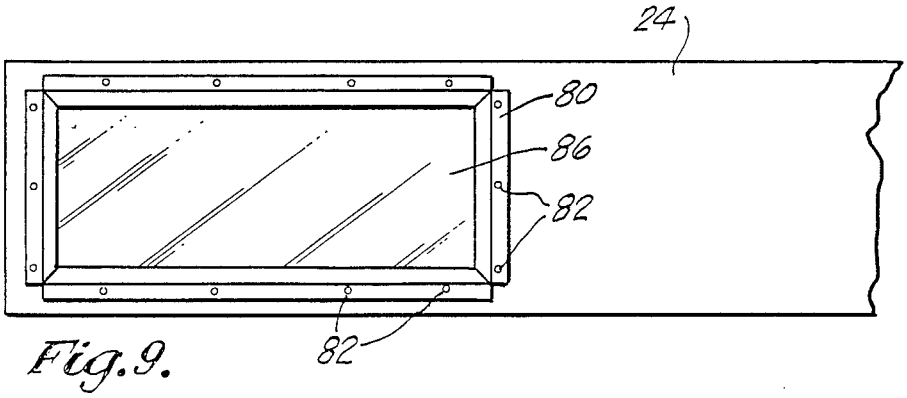
FIG. 9 shows a top view of the body case shown in FIG. 7.

Referring now to FIGS. 7, 8 and 9, a second preferred embodiment of the subject invention is shown in which a body case 72 is useful for containing the remains of a person who died of a contagious or potentially contagious disease. As previously mentioned, it is desirable that such persons remains be kept isolated from the surrounding environment and particularly isolated from people who may be in the surrounding area. However, such deceased person, or his family or friends, may desire a funeral in which a final viewing takes place. Body case 72 differs from body case 10 shown in FIG. 1, in that a viewing window 74 is provided in cover 24. As was previously required with respect to body case 10, the interior of body case 72 must be maintained in an air tight condition with respect to the surrounding environment. Thus, window 74 must be fabricated in cover 24 in an air tight manner.

Window 74 is formed in an opening 76 cut in the metal forming cover 24. The opening 76 includes a moisture and support member 78 bent along the periphery thereof at a one hundred and twenty degree angle from the plane of cover 24. Member 78 fun ctions similarly to members 34, 36 and 69 previously described. An offset bracket 80 is placed on cover 24 remote from the edge formed by member 78 around opening 76. The lower portion of bracket 80 is held against cover 24 by a series of air tight rivets 82 in a well known manner. The raised portion of bracket 80 fits over a gasket 84 and transparent window 86 to compressively hold window 86 against gasket 84 after the rivets 82 are inserted to hold the lower portion of bracket 80 against cover 24. Caluking 88 may also be inserted between window 86 and the vertical portion of bracket 80 for additional sealing. Coupled in this manner, the junction between window 86 and cover 24 is an air tight sealed junction. Further, member 78 prevents moisture from seeping into the junction between window 86 and gasket 84. The width of window 86, including the bracket 80, should be made to be as close to the full width of cover 24 as strength considerations permit. The length of window, including bracket 80, should be made to be no more than on half the length of cover 24 so that the body cases 72 may be easily stacked prior to usage.

Where body case 72 is to contain the remains of a person who died of a contagious disease, it normally is desirable to cremate such remains. Ideally, this should be done without having to open body case 72 to remove the remains therefrom. By making transparent window 86 of a plastic material which quickly melts when the entire body case 72 is placed in a crematorium, the cremation process can occur by merely inserting case 72 directly into the crematorium. Thus, body case 72 may be placed directly in a conventional coffin for a final viewing and other desired ceremonies associated with a conventional funeral. Thereafter, body case 72 may be lifted from the coffin and taken directly to the crematorium for disposal of the body in a known manner. In this manner, no potential contamination of the persons associated with the funeral and final disposal of the remains will occur.

What is claimed is:

1. A body transporting, viewing and cremation container for containing the remains of a decedent during movement of such remains between different locations, during display of the decedent at viewing a ceremony and for cremating said remains, all while maintaining such remains isolated from contaminating the environment surrounding said container, said container comprising:

an airtight container portion including four sides, a bottom and cover receiving means, said cover receiving means including a flange attached to said sides and a first liquid trapping member extending from the inner periphery of said flange and towards said sides, said first liquid trapping member ending short of the sides;

cover means for being held over said cover receiving means, said cover receiving means including a first gasket over said flange for forming an airtight seal between said cover means and said container portion;

an opening within said cover means, including a liquid trapping member bent from the edges of said opening by more than ninety degrees and extending into the top portion of the interior of said container;

a transparent window of a material which is melted when placed in an operating crematorium; and second gasket means for sealing said window over said opening, whereby the interior of said container is isolated from the surrounding environment.

2. The invention according to claim 1 wherein said cover means includes a cover, said first gasket being postioned between said cover and said cover receiving means and latch locking means for compressively locking said cover means against said gasket and cover receiving means.

3. The invention according to claim 2 wherein said means for sealing said window includes an offset bracket for being attached to said cover means and for compressively holding said window against said gasket.

4. The invention according to claim 1 wherein said means for sealing said window includes an offset bracket for being attached to said cover means and for compressively holding said window against said gasket.

* * * * *